US008631832B2

(12) United States Patent
Heger

(10) Patent No.: US 8,631,832 B2
(45) Date of Patent: Jan. 21, 2014

(54) SHEET FORMING SCREEN

(75) Inventor: Wolfgang Heger, Nideggen (DE)

(73) Assignee: Andritz Technology and Asset Management GmbH, Graz (AT)

( * ) Notice: Subject to any disclaimer, the term of this patent is extended or adjusted under 35 U.S.C. 154(b) by 0 days.

(21) Appl. No.: 13/521,667

(22) PCT Filed: May 17, 2011

(86) PCT No.: PCT/EP2011/057978

§ 371 (c)(1),
(2), (4) Date: Jul. 11, 2012

(87) PCT Pub. No.: WO2011/144616

PCT Pub. Date: Nov. 24, 2011

(65) Prior Publication Data

US 2013/0105030 A1 May 2, 2013

(30) Foreign Application Priority Data

May 21, 2010 (DE) ..... 10 2010 017 055

(51) Int. Cl.
*D21F 1/10* (2006.01)
*D21F 7/08* (2006.01)
*D03D 23/00* (2006.01)

(52) U.S. Cl.
USPC ..... 139/383 A; 139/383 AA; 139/383 R; 139/408; 139/411; 162/358.2

(58) Field of Classification Search
USPC ..... 162/306, 348, 358.2, 358.4, 900, 902, 162/903, 145; 139/383 A, 425 A, 383 AA; 442/181, 320, 203, 239, 326, 240, 205, 442/206, 207, 224
See application file for complete search history.

(56) References Cited

U.S. PATENT DOCUMENTS 4,314,589 A * 2/1982 Buchanan et al. ..... 139/383 A
4,359,069 A * 11/1982 Hahn ..... 139/425 A (Continued)

FOREIGN PATENT DOCUMENTS

CA 1 115 177 12/1981
DE 3 928 484 6/1990

(Continued)

OTHER PUBLICATIONS

Smook, G., Handbook for Pulp and Paper Technologists, 4th edition, Canadian: 1987; p. 223, ISBN 0-919803-00-7.

(Continued)

*Primary Examiner* — Bobby Muromoto, Jr.
(74) *Attorney, Agent, or Firm* — Roylance, Abrams, Berdo & Goodman, L.L.P.

(57) ABSTRACT

A sheet forming screen is described which is formed as a multi-layer fabric, wherein the fabric has a longitudinal thread repeat of sixteen longitudinal threads, four longitudinal threads (11 to 14) of which are formed as upper longitudinal threads, eight longitudinal threads (31 to 38) of which are formed as lower longitudinal threads, and the remaining four longitudinal threads (21 to 24) of which form two functional longitudinal thread pairs of two longitudinal threads each arranged next to each other which alternately complete the first weave, wherein at least one of the four longitudinal threads which form the two functional longitudinal thread pairs extends both in the upper fabric layer and in the lower fabric layer and thereby binds the lower fabric layer to the upper fabric layer.

10 Claims, 13 Drawing Sheets

(56) References Cited

U.S. PATENT DOCUMENTS

| | | | | |
|---|---|---|---|---|
| 4,569,375 | A | 2/1986 | Borel | |
| 4,739,803 | A * | 4/1988 | Borel | 139/383 A |
| 4,974,642 | A | 12/1990 | Taipale | |
| 5,152,326 | A | 10/1992 | Vohringer | |
| 5,454,405 | A * | 10/1995 | Hawes | 139/383 A |
| 5,826,627 | A * | 10/1998 | Seabrook et al. | 139/383 A |
| 6,112,774 | A * | 9/2000 | Wilson | 139/383 A |
| 6,145,550 | A | 11/2000 | Ward | |
| 6,227,256 | B1 * | 5/2001 | Quigley | 139/383 A |
| 6,244,306 | B1 * | 6/2001 | Troughton | 139/383 A |
| 6,253,796 | B1 * | 7/2001 | Wilson et al. | 139/383 A |
| 6,379,506 | B1 * | 4/2002 | Wilson et al. | 162/348 |
| 6,860,299 | B2 | 3/2005 | Kuji | |
| 6,860,969 | B2 * | 3/2005 | Troughton | 162/348 |
| 6,896,009 | B2 * | 5/2005 | Ward | 139/383 A |
| 6,904,942 | B2 * | 6/2005 | Odenthal | 139/383 A |
| 7,007,722 | B2 * | 3/2006 | Quigley et al. | 139/383 A |
| 7,048,829 | B2 * | 5/2006 | Heger et al. | 162/348 |
| 7,048,830 | B2 * | 5/2006 | Heger et al. | 162/348 |
| 7,270,152 | B2 * | 9/2007 | Ueda et al. | 139/383 A |
| 7,306,014 | B2 * | 12/2007 | Nagura et al. | 139/383 A |
| 7,357,156 | B2 * | 4/2008 | Ueda et al. | 139/383 A |
| 7,357,157 | B2 * | 4/2008 | Ueda | 139/383 A |
| 7,373,957 | B2 * | 5/2008 | Heger et al. | 139/383 A |
| 7,406,985 | B2 * | 8/2008 | Heger et al. | 139/383 A |
| 7,426,944 | B2 * | 9/2008 | Danby et al. | 139/383 A |
| 7,585,394 | B2 * | 9/2009 | Heger et al. | 162/348 |
| 7,770,606 | B2 * | 8/2010 | Heger et al. | 139/383 A |
| 7,874,322 | B2 | 1/2011 | Ueda | |
| 2004/0089365 | A1 * | 5/2004 | Heger et al. | 139/383 A |
| 2006/0162804 | A1 * | 7/2006 | Heger et al. | 139/383 A |
| 2006/0260708 | A1 * | 11/2006 | Ueda et al. | 139/383 A |
| 2007/0125911 | A1 * | 6/2007 | Heger et al. | 245/2 |
| 2007/0157987 | A1 * | 7/2007 | Ward | 139/383 A |
| 2007/0157988 | A1 * | 7/2007 | Heger et al. | 139/383 A |
| 2009/0308482 | A1 * | 12/2009 | Heger et al. | 139/383 A |

FOREIGN PATENT DOCUMENTS

| | | |
|---|---|---|
| DE | 3 938 159 | 5/1991 |
| DE | 4 229 828 | 3/1994 |
| DE | 10 030 650 | 5/2002 |
| EP | 0 069 101 | 1/1983 |
| EP | 0 093 096 | 11/1983 |
| EP | 0 097 966 | 1/1984 |
| EP | 0 136 284 | 4/1985 |
| EP | 0 432 413 | 6/1991 |
| EP | 0 794 283 | 9/1997 |
| EP | 1 220 964 | 6/2005 |
| EP | 1 767 692 | 3/2007 |
| EP | 1 826 316 | 8/2007 |
| EP | 1 527 229 | 1/2008 |
| JP | 2003-013382 | 1/2003 |
| JP | 2008-138309 | 6/2008 |
| WO | 93/00472 | 1/1993 |
| WO | 99/06630 | 2/1999 |
| WO | 99/06632 | 2/1999 |
| WO | 02/14601 | 2/2002 |
| WO | 2004/085740 | 10/2004 |
| WO | 2004/085741 | 10/2004 |
| WO | 2007/087852 | 8/2007 |
| WO | 2009/044914 | 4/2009 |

OTHER PUBLICATIONS

International Search Report for PCT/EP2011/057978, dated Mar. 11, 2011.

International Preliminary Report on Patentability, dated Dec. 6, 2012, for corresponding PCT/EP2011/057978.

Japanese Office Action, dated Sep. 10, 2013, in corresponding Japanese Application No. 2012-548462, and English translation thereof.

* cited by examiner (A)

(B)

(A)

(B)

(A)

(B)

| | 11 | 21 | 22 | 12 | 13 | 23 | 24 | 14 |
|---|---|---|---|---|---|---|---|---|
| 120 | | x | | | x | | | x |
| 119 | x | | | x | | x | | |
| 118 | | x | | | x | | | x |
| 117 | x | | | x | | x | | |
| 116 | | x | | | x | | | x |
| 115 | x | | | x | | | x | |
| 114 | | x | | | x | | | x |
| 113 | x | | | x | | | x | |
| 112 | | | x | | x | | | x |
| 111 | x | | | x | | | x | |
| 110 | | | x | | x | | | x |
| 109 | x | | | x | | | x | |
| 108 | | | x | | x | | | x |
| 107 | x | | | x | | | x | |
| 106 | | | x | | x | | | x |
| 105 | x | | | x | | x | | |
| 104 | | | x | | x | | | x |
| 103 | x | | | x | | x | | |
| 102 | | x | | | x | | | x |
| 101 | x | | | x | | x | | |

Fig. 5a

| | 31 | 32 | 21 | 22 | 33 | 34 | 35 | 36 | 23 | 24 | 37 | 38 |
|---|---|---|---|---|---|---|---|---|---|---|---|---|
| 210 | | | | x | | | | | | x | | |
| 209 | | | | | | x | | | | | | x |
| 208 | | x | | | | | | x | | | | |
| 207 | | | | | x | | | | | | x | |
| 206 | x | | | | | | x | | | | | |
| 205 | | | x | | | | | | x | | | |
| 204 | | | | | | x | | | | | | x |
| 203 | | x | | | | | | x | | | | |
| 202 | | | | | x | | | | | | x | |
| 201 | x | | | | | | x | | | | | |

Fig. 6a

| | | | | | | | | |
|---|---|---|---|---|---|---|---|---|
| 112 | | x | | | x | | | x |
| 111 | x | | | x | | x | | |
| 110 | | x | | | x | | | x |
| 109 | x | | | x | | | x | |
| 108 | | x | | | x | | | x |
| 107 | x | | | x | | | x | |
| 106 | | | x | | x | | | x |
| 105 | x | | | x | | | x | |
| 104 | | | x | | x | | | x |
| 103 | x | | | x | | x | | |
| 102 | | | x | | x | | | x |
| 101 | x | | | x | | x | | |
| | 11 | 21 | 22 | 12 | 13 | 23 | 24 | 14 |

Fig. 9a

| | 31 | 32 | 21 | 22 | 33 | 34 | 35 | 36 | 23 | 24 | 37 | 38 |
|---|---|---|---|---|---|---|---|---|---|---|---|---|
| 208 | x | | | | | x | x | | | | | x |
| 207 | | x | | - | x | | | x | | | x | |
| 206 | x | | | | | x | x | | | | | x |
| 205 | | x | | | x | | | x | - | | x | |
| 204 | x | | | | | x | x | | | | | x |
| 203 | | x | - | | x | | | x | | | x | |
| 202 | x | | | | | x | x | | | | | x |
| 201 | | x | | | x | | | x | | - | x | |

SHEET FORMING SCREEN

The invention relates to a sheet forming screen made of a multi-layer fabric as it is used in the process of papermaking in the sheet forming section of a wet end of a paper machine for draining a fiber suspension.

A main process in papermaking is the forming of the sheet (=sheet forming) which is effected by draining a fiber suspension by means of filtration in the sheet forming section of the wet end of a paper machine by using a so-called sheet forming screen or paper machine screen.

In this respect, the fiber suspension is a mixture of wood or cellulose fibers, fillers and auxiliary chemical agents suspended in water.

In order to be able to produce a paper sheet as uniform as possible, it is necessary to increase or set the amount of water within the fiber suspension immediately before the sheet formation to approximately 99%. This ensures that the fibers can be distributed uniformly in the water, which is beneficial to the quality of the sheet to be formed.

The amount of water is reduced to approximately 80% by the above-mentioned filtration process within the sheet forming section, i.e. during the sheet forming process. The paper fibers and the fillers and auxiliary agents remain on the papermaking screen in a uniformly distributed manner in the form of a nonwoven fabric.

While in the past the draining process took place mainly by means of a paper machine screen applied to a Fourdrinier paper machine, mainly twin wire paper machines are being used these days, for example in the form of so-called gap formers. These twin wire paper machines are characterized in that the fiber suspension is sprayed into a gap which is formed between two paper machine screens, so that draining can take place simultaneously through both screens, whereby it is possible to significantly accelerate the filtration process and thus also the production rate of the papermaking machine. There are papermaking machines these days for types of paper having a low surface weight, which are capable of producing with speeds of more than 2,000 m/min.

These extreme requirements for the paper to be produced and the conditions existing in the papermaking machine require sheet forming screens which are designed especially for this purpose and which offer high fiber support, high openness and a high mechanical stability at the same time. In addition, a low tendency to marking of the fabric, i.e. a high uniformity of the paper forming screen is necessary especially for the domain of graphic papers.

Multi-layer paper machine screens have proven of value for these fields of application over the past years, comprising two sides formed in a different manner, which are adapted to the particular purpose of use. Screens of this type have a paper side which is formed by the upper side of an upper tissue. In habitual language use, the paper side is also referred to as the upper side of the screen, and is relevant for forming the paper sheet. In addition, these screens have a machine side which is formed by the lower side of a lower fabric. The machine side which can also be referred to as the lower side of the screen contacts the members of the papermaking machine. The respective screen side has a machine direction and a cross direction. In this respect, machine direction (also MD for "machine direction") refers to the running direction of the paper web and therefore also to the running direction of the paper machine screen, and the cross direction (also CMD for "cross machine direction"), sometimes also referred to as cross machine direction, is the direction turned by 90° in the plane of the paper machine screen, i.e. the direction located transverse to the running direction of the paper and the screen.

Due to the very specific configuration of modern paper machine screens, usually neither the paper and machine side nor the machine and cross direction are interchangeable, as otherwise the mode of operation of the screen would not be ensured or would not be ensured sufficiently. For example, the machine direction threads (=longitudinal threads) on the machine side which realize movement/circulation of the screen, can be protected against wear by transverse threads projecting or protruding significantly. Providing a balanced relationship of longitudinal and transverse threads on the paper side can ensure a good depositing possibility for the paper fibers. With respect to the fiber support, but also with respect to the tendency to marking of the screen, the most simple and at the same time the oldest basic weave of textile engineering has proven of value for the upper fabric and thus for the paper side, namely the so-called plain weave. In this kind of weave, the repeat (=the smallest repeating unit of the weave) of which is formed exactly by two warp threads (as a general rule, the longitudinal threads/machine direction threads of the screen are formed by the warp threads) and two weft threads (as a general rule, the transverse threads of the screen are formed by the weft threads), the threads are connected to a fabric in a particularly intimate and uniform manner. Although the plain weave is very well suited for forming a paper sheet and is hence very well suited for the paper side, it is usually not suited very well for the machine side. If a paper machine screen is provided with a plain weave paper side, it can therefore be advisable to provide for a second fiber layer underneath the plain weave, forming the machine side of the screen, which gives the screen sufficient stability and wearing potential.

In this respect, the connection of the two layers (i.e. of the upper fabric forming the paper side and the lower fabric forming the machine side) is a particular challenge, amongst others due to the fact that the plain weave favorable for the paper side involves particularly unfavorable preconditions for such a layer connection.

The state of the art describes different approaches for connecting two screen fabric layers, one approach of which describes the use of additional, separate binder threads extending in a longitudinal direction or a transverse direction. According to this approach, two finished and completed fabric layers are connected to each other by separate, fabric-external binder threads, which binder threads do not contribute to/are not required for establishing the corresponding fabric layer weave. Both fabric layers consist of longitudinal threads and transverse threads which extend exclusively in the respective fabric layer and thereby generate the respective fabric layer pattern and/or the respective fabric layer weave completely. This approach is, for example, described in CA 1 115 177 A1, where separate binder weft threads are used which bind with warp threads of the upper fabric and warp threads of the lower fabric, and in DE 39 28 484 A1 in which separate warp threads are used as binder threads. Other examples can be found in DE 42 29 828 A1, WO 93/00472, and EP 0 136 284 A2. The separate binder threads are usually configured to be thinner than the threads forming the respective fabric layer (cf., for example, CA 1 115 177 A1), as the binder threads must be incorporated in the fabric structure in addition to the fabric forming threads. In this respect, little space is provided for such separate binder threads especially in a plain weave. Otherwise, the binder threads would interfere with the originally homogeneous structure of the weave, so that imperfections which cause markings in the paper would be produced especially in the plain weave provided on the paper side. However, practice has shown that the thin binder threads wear out and break rather fast especially in paper machines which process a high amount of abrasive fillers or the construction of which puts a heavy strain on the screens with bending in the machine direction, so that the two fabric layers are first displaced and then separated as a result thereof. It goes without saying that it is impossible to make high quality paper by means of a fabric/screen changed in such a manner.

As an alternative, at least two transverse threads can be used which interact as a so-called functional transverse thread pair. Either one or both of the transverse threads of a functional pair extend alternately in the upper fabric and the lower fabric. In this respect, both transverse threads of a functional pair can form a virtually uninterrupted transverse thread of a paper side plain weave, i.e. an upper interconnected transverse thread. Those thread portions of the functional pair which are currently not required for forming the virtually uninterrupted transverse thread on the paper side extend in the interior the fabric and can be used for binding the lower fabric to the upper fabric. In this respect, the thread portion binding the lower fabric can, for example, complete the lower fabric or its weave at the same time. For example, an upper transverse thread may be provided between two functional transverse thread pairs, which completes exclusively the plain weave (i.e. which extends only in the upper fabric), but has no binding function. Exemplary embodiments of this approach can be found, for example, in EP 0 097 966 A2, EP 794 283 A1, WO 99/06630 A1, WO 99/06632 A1, and WO 02/14601 A1. It is an advantage of this solution that the binder threads and the transverse threads forming the upper fabric can have the same diameter, whereby uniformity of the paper side can be increased. In addition, material usage can be limited. On the other hand, the binding strength is reduced. Moreover, this approach has not been able to avoid interior wear and layer separation connected therewith in a sufficient manner. Deflection of the screen to rollers and draining members in the paper machine leads to a bending of the screen in a longitudinal direction. In this respect, always one of the two fabric layers is compressed, whereas the other one is expanded. Friction occurs at the inner sides of the two individual layers, which leads to internal wear. Besides, the binder threads oriented in a transverse direction are slightly moved in the fabric, which leads to friction and therefore wear also between the binder threads oriented in a transverse direction and the threads incorporated exclusively in one layer.

Another alternative may be a connection of the layers by so-called functional longitudinal thread pairs. If both fabric layers are penetrated by threads extending in the main bending direction, the differences in length are balanced at very short intervals. The possibility of an internal relative movement is reduced to a degree that is not relevant anymore in practice. In this context, the solutions described in DE 100 30 650 C1 and in US 2007/0 157 988 have shown in practice that the binding of a machine side to a paper side plain weave by means of functional longitudinal thread pairs described therein does not lead to layer separation anymore. Due to the long float of the machine side cross direction threads, the number and distribution of the so-called warp change locations and the distribution of paper to machine side machine direction threads, these fabrics meet their limits with respect to markings in the paper, water content in the fabric and fiber support, and can hardly be used for light-weight graphic papers.

EP 0 069 101 and EP 093 096 also show a layer connection by means of functional longitudinal thread pairs.

EP 1 767 692 A2 discloses a multi-layer fabric, wherein a paper side plain weave is bound to a machine side 4-shaft weave. In the upper fabric, an upper longitudinal thread extending exclusively in the upper fabric and a functional pair of longitudinal threads are provided alternately. The respective upper longitudinal thread extends above two lower longitudinal threads arranged in pairs next to each other, which extend exclusively in the lower fabric. The respective functional longitudinal thread pair forms, on the one hand, an upper composite longitudinal thread in the upper fabric, and, on the other hand, binds the lower fabric to the left-hand side and to the right-hand side of a lower longitudinal thread which is arranged underneath the upper composite longitudinal thread and extends exclusively in the lower fabric. The lower fabric entirely consists of lower transverse threads and lower longitudinal threads and is bound only to the upper fabric by the thread portion of the functional longitudinal thread pairs meanwhile extending in the lower fabric (the binding thread portion acting as a separate, fabric-external binder thread). The fabric has a longitudinal thread repeat of eighteen longitudinal threads, three of which are formed as upper longitudinal threads and nine of which are formed as lower longitudinal threads, the remaining six longitudinal threads forming three functional pairs. Depending on the definition (see below), a longitudinal thread ratio of 2:3 (6:9) or 1:2 (6:12) is obtained (if one considers the lower longitudinal threads arranged in pairs next to each other as respectively one lower longitudinal thread, a ratio of 1:1 (6:6) or 2:3 (6:9) is obtained).

Similar approaches are described in WO 2004/085740 A2 and in WO 2004/085741 A1, wherein WO 2004/085740 A2 shows a fabric having a longitudinal thread repeat of 20 threads which are distributed into four upper longitudinal threads, four functional pairs and eight lower longitudinal threads. The fabric shown in WO 2004/085741 A1 has a longitudinal thread repeat of 16 threads which are distributed into four upper longitudinal threads, four functional pairs and four lower longitudinal threads, so that a longitudinal thread ratio of 2:1 (8:4) or 1:1 (8:8) is obtained. In both fabrics, the lower fabric is bound only to the upper fabric by thread portions of the functional pairs, i.e. the lower fabric is formed entirely and finally by lower longitudinal threads and lower transverse threads.

EP 1 826 316 A2 describes a fabric having a longitudinal thread repeat of four upper longitudinal threads, twelve lower longitudinal threads and four functional pairs (i.e. a longitudinal thread repeat of 24 threads). The upper warps and the functional pairs form a paper side plain weave which is bound to a complete lower side by means of the functional pairs. At least three different warp systems are required for making the fabric. The upper longitudinal threads and the functional pairs are arranged alternately, which leads to the paper side weave pattern overlying with the two different upper warp systems.

EP 1 527 229 B1 and EP 1 220 964 B1 each disclose a triplet warp thread composed of three warp threads, the warp threads of which respectively extend in the upper fabric and in the lower fabric.

The problem of the invention is to provide a sheet forming screen made of a multi-layer fabric, which is easy to produce and meets the requirements described above, i.e., for example, a high fiber support, a high mechanical stability, a low tendency to marking and a stable layer connection.

To solve this problem, the invention provides a sheet forming screen according to independently claimed limitations. Further embodiments of the screen according to the invention are described in the dependent claims.

According to the invention, the sheet forming screen is formed of a multi-layer fabric having a longitudinal thread repeat of sixteen longitudinal threads, four longitudinal threads of which are formed as upper longitudinal threads and eight longitudinal threads of which are formed as lower longitudinal threads. The remaining four longitudinal threads form two functional longitudinal thread pairs of respectively two longitudinal threads arranged next to each other.

According to a first embodiment of the invention, each of the four longitudinal threads forming the two functional longitudinal thread pairs extends both in the upper fabric layer and in the lower fabric layer, whereby the upper fabric layer is connected firmly to the lower fabric layer.

According to the first embodiment of the invention, the upper longitudinal threads partially form the weave of the upper fabric layer (this is, for example, the paper side weave) together with transverse threads extending in the upper fabric layer, the eight lower longitudinal threads partially form the weave of the lower fabric layer (this is, for example the machine side weave) together with transverse threads extending in the lower fabric layer, and the two functional longitudinal thread pairs formed by the remaining four longitudinal threads complete both the weave of the upper fabric layer and the weave of the lower fabric layer. In this respect, the longitudinal threads of the two functional pairs form two upper composite longitudinal threads and two lower composite longitudinal threads which insert in the corresponding weave pattern.

According to a second embodiment of the invention, at least one of the four longitudinal threads forming the two functional longitudinal thread pairs extends both in the upper fabric layer and in the lower fabric layer, whereby the upper fabric layer is connected to the lower fabric layer. The longitudinal threads of the two longitudinal thread pairs which do not extend in both fabric layers extend alternately in the upper layer and between the two layers, i.e. alternately in the upper layer and in the interior of the fabric. Preferably, all four longitudinal threads forming the two functional longitudinal thread pairs extend in the second embodiment of the invention as well both in the upper fabric layer and in the lower fabric layer, so that a reliable connection of the fabric layers is ensured.

According to the second embodiment of the invention, the upper longitudinal threads partially form the weave of the upper fabric layer (this is, for example, the paper side weave) together with transverse threads extending in the upper fabric layer, and the eight lower longitudinal threads already form the complete weave of the lower fabric layer (this is, for example, the machine side weave) together with transverse threads extending in the lower fabric layer. The two longitudinal threads of each longitudinal thread pair alternately complete the weave of the upper fabric layer. Thus, the longitudinal threads of the two functional pairs form two upper composite longitudinal threads which complete the weave of the upper fabric layer. In addition, the at least one longitudinal thread extending both in the lower and in the upper fabric layer binds the lower fabric layer completely formed by the lower longitudinal threads to the upper fabric layer, acting as a separate binder thread. If both longitudinal threads of a functional pair extend both in the upper fabric layer and in the lower fabric layer, the two longitudinal threads of a longitudinal thread pair alternately complete the first weave and, in addition, alternately bind the lower fabric layer completely formed by the lower longitudinal threads to the upper fabric layer. This means, in the latter case, that the thread portions of a functional pair which are currently not used for forming the upper composite longitudinal thread integrate at least a transverse thread extending in the lower fabric and acting as a separate binder thread, in order to thereby connect the lower fabric layer to the upper fabric layer. This has the advantage of an increased number of binding points and hence of a stronger layer connection. In addition, both threads of a functional pair have the same thread length in the latter case, which leads to a uniform interlace.

According to the invention, the connection of the upper layer to the lower layer is thus realized (at least in part) by functional longitudinal thread pairs which brings about the above-described advantages in comparison with a layer connection by means of separate connection threads or by means of functional transverse thread pairs. However, the invention should also include, for example, screens of a type where, for example, separate connecting threads are provided in addition to the functional longitudinal thread pairs.

Due to the fact that the fabric has a longitudinal thread repeat of 16 longitudinal threads and due to the claimed distribution of the sixteen longitudinal threads into four upper longitudinal threads, eight lower longitudinal threads and two functional pairs, the paper forming screen according to the invention can be produced by means of a weaving machine provided with a shaft package of sixteen shafts and two warp beams (if the longitudinal threads are formed by warp threads). In this respect, the sixteen longitudinal threads can be separated into two warp beam units of eight threads each, the first unit comprising the eight lower longitudinal threads of the respective repeat and the second unit comprising the remaining eight longitudinal threads of the respective repeat. A weaving machine equipped with sixteen shafts and two warp beams is required for the production of a plurality of other fabrics/screens, so that the screen according to the invention can be produced without any problems by means of an existing weaving machine. This means that it is not required to use a separate weaving machine or to rebuild an existing weaving machine (for example, by adding or by withdrawing shafts) for producing the screen according to the invention. The screen according to the invention can rather be produced during production breaks of another 16-shaft screen without a prior rebuilding of the machine being necessary.

The claimed distribution/allocation of the sixteen longitudinal threads results in a ratio of upper longitudinal threads to lower longitudinal threads of 4:8 or 1:2. For the first embodiment of the screen according to the invention, respectively two of the four longitudinal threads of the two functional pairs can be assigned to the lower and upper fabric layer, respectively, as these four longitudinal threads contribute to the formation of fabric in both layers and respectively form two composite longitudinal threads, so that a total longitudinal thread ratio of 6:10 or 3:5 is obtained. If in the second embodiment of the screen according to the invention only the two upper composite longitudinal threads are taken into consideration when calculating the longitudinal thread ratio, a longitudinal thread ratio of 6:8 or 3:4 is obtained. If the four longitudinal threads are distributed evenly to the upper fabric and to the lower fabric (although the at least one longitudinal thread in the lower fabric layer only acts as a separate binder thread), a ratio of 6:10 or 3:5 is obtained, just like in the first embodiment. The described longitudinal thread ratio of 3:5 or 3:4 and the reduced longitudinal thread number in the upper fabric layer involved, which usually forms the paper side, favors the formation of paper side cross meshes, the extension of which is greater in a screen cross direction than in a screen longitudinal direction. Such cross meshes enable a high fiber support, as the paper fibers are oriented mainly in a machine direction due to the paper machine's operation and the flow conditions in the head box thereof. This means that the screen surface has a higher fiber support ability with a constant total thread number and a comparable permeability and a comparable design. Hence, a paper side of the screen oriented in a rather transverse manner provides an improved fiber support.

The comparatively large number of lower longitudinal threads balances a paper side reduction in strength and an increase in screen expansion in a machine direction going along with the formation of cross meshes, i.e. the reduction in strength and the increase in expansion of the screen in the critical machine direction caused by a reduction of paper side longitudinal threads can be compensated by a greater number of machine side longitudinal threads.

According to an embodiment of the invention, exactly two upper longitudinal threads and/or exactly four lower longitudinal threads are arranged in the fabric between two functional longitudinal thread pairs, whereby a particularly uniform paper side and machine side, respectively, can be presented.

According to another embodiment of the invention, the upper longitudinal threads and the longitudinal threads of the functional pairs substantially have the same diameter. If the longitudinal threads are formed by warp threads, the upper longitudinal threads and the longitudinal threads of the functional pairs can therefore be wound up on a common warp beam. The diameter of the lower longitudinal threads may, for example, equal the diameter of the upper longitudinal threads and the longitudinal threads of the functional pairs (especially in the first embodiment of the invention). Alternatively, the diameter of the lower longitudinal threads may be greater than the diameter of the upper longitudinal threads and of the longitudinal threads of the functional pairs (especially in the second embodiment of the invention).

According to another embodiment of the invention, all transverse threads extending in the upper fabric are formed as upper transverse threads which are arranged exclusively in the upper fabric, and/or all transverse threads extending in the lower fabric are formed as lower transverse threads which are arranged exclusively in the lower fabric.

The transverse threads extending in the lower fabric layer may, for example, be greater in diameter than the transverse threads extending in the upper fabric layer.

The ratio of transverse threads extending in the upper fabric to transverse threads extending in the lower fabric may, for example, be greater than 1, for example at least or exactly 2:1 or, for example, at least or exactly 3:2. The greater number of transverse threads extending in the upper fabric favors the formation of the above described paper side transverse meshes. However, the invention is not limited to a particular number of transverse threads extending in the lower fabric and in the upper fabric.

The first weave (=weave of the upper fabric layer) may, for example, be a plain weave, and the second weave (=weave of the lower fabric layer) may, for example, be a 5-shaft weave (especially in the first embodiment/alternative of the invention; in this respect, the four longitudinal threads of the two functional pairs form two lower composite longitudinal threads which are considered as two lower longitudinal threads for the description/evaluation of the second weave) or a 4-shaft weave (especially in the second embodiment/alternative of the invention) (in this regard, 4-shaft weave or 5-shaft weave means that the weave can be made by means of 4 or 5 shafts; in other words, the repeat of such a weave has 4 or 5 warp threads and longitudinal threads, respectively). However, the invention is not limited to a particular weave of the upper fabric or to a particular weave of the lower fabric. Upper fabrics and lower fabrics may, for example, also have the same weave, such as a plain weave.

Further variations of the screen according to the invention can be derived from the following description of exemplary embodiments.

Hereinafter, some of the terms used in this application shall be defined:

Longitudinal threads are threads of the screen/fabric which are arranged in the machine direction of the paper machine. In the flat woven screen, the longitudinal threads are formed by the warp threads of the weaving loom. Circular woven fabrics, in contrast, realize the longitudinal threads by means of wefts.

Transverse threads are threads of the screen/fabric which are arranged transverse to the machine direction of the paper machine. In the flat woven screen, the transverse threads are formed by the wefts. Circular woven fabrics, in contrast, realize the transverse threads by means of the warps of the weaving loom.

A fabric layer is a single-layer fabric consisting of transverse threads and longitudinal threads (or warps and wefts).

The upper fabric or the upper fabric layer is a fabric layer which is usually formed in a particularly fine manner, which usually forms the paper side (=the upper side of the upper fabric oriented outwards) of the screen, on which the paper fiber layer is formed. The upper layer is located on the "logical upper side" of the screen.

The lower fabric or the lower fabric layer is a fabric layer which is usually formed in a particularly robust manner, which usually forms the machine side (=the lower side of the lower fabric oriented outwards) of the screen, which enters in direct contact with the driving and draining members of the paper machine generating wear.

Upper longitudinal threads are threads which are located exclusively in the upper fabric and which are there interwoven with transverse threads extending in the upper fabric. The upper longitudinal threads never leave the upper fabric, i.e. they do not change into the lower fabric.

Upper transverse threads are threads which are located exclusively in the upper fabric and which are there interwoven with the upper longitudinal threads (as well as with the longitudinal threads of the functional pairs). The upper transverse threads never leave the upper fabric, i.e. they do not change into the lower fabric.

Lower longitudinal threads are threads which are located exclusively in the lower fabric and which are there interwoven with transverse threads extending in the lower fabric. The lower longitudinal threads never leave the lower fabric, i.e. they do not change into the upper fabric.

Lower transverse threads are threads which are located exclusively in the lower fabric and which are there interwoven with the lower longitudinal threads (in the first embodiment of the invention also with the longitudinal threads of the functional pairs). The lower transverse threads never leave the lower fabric, i.e. they do not change into the upper fabric.

A functional longitudinal thread pair consists of two longitudinal threads located directly next to each other, the position of which in the screen/fabric is not limited to one fabric layer, i.e. the longitudinal threads of a functional pair do not extend exclusively in one fabric layer. Usually, both longitudinal threads of a functional longitudinal thread pair extend both in the lower fabric and in the upper fabric, i.e. the longitudinal threads of a longitudinal thread pair change between the upper and the lower fabric layers (in the first embodiment of the invention as well as in an alternative of the second embodiment of the invention). However, one or both longitudinal threads of a functional pair may also change between one of the two layers and the interior of the fabric (according to a second alternative of the second embodiment). According to the first embodiment of the invention, the two threads of a functional pair together fulfill both the task of an upper longitudinal thread (for example of an upper warp)

and of a lower longitudinal thread (for example of a lower warp), and, in addition, interconnect the different fabric layers due to their extension. An upper longitudinal thread formed in such a manner and a lower longitudinal thread formed in such a manner can also be referred to as "upper and lower composite longitudinal threads, respectively". According to the second embodiment of the invention, the two longitudinal threads of a functional pair together fulfill the task of an upper fabric-internal longitudinal thread ("upper composite longitudinal thread") and, if applicable, that of a lower fabric-external binder thread.

A longitudinal thread repeat is the smallest repeating unit of longitudinal threads in the fabric. If the longitudinal threads are formed by warp threads, the thread number of the longitudinal thread repeat corresponds to the number of shafts required for producing the fabric.

BRIEF DESCRIPTION OF DRAWINGS

The invention will hereinafter be described in more detail by means of two exemplary embodiments and with reference to the drawing, in which:

FIG. 5*a* shows the weave pattern of the upper fabric, the binding locations where an upper transverse thread is bound in by an upper longitudinal thread or an upper composite longitudinal thread being marked with an "x", FIG. 6*a* shows the weave pattern of the lower fabric, the binding locations where a lower transverse thread is bound in by a lower longitudinal thread or a lower composite longitudinal thread being marked with an "x", FIG. 9*a* shows the weave pattern of the upper fabric, the binding locations where an upper transverse thread is bound in by an upper longitudinal thread or an upper composite longitudinal thread being marked with an "x"

FIGS. 1 to 7 illustrate a fabric according to a first embodiment of the invention. The fabric is a multi-layer fabric and may, for example, be used as a screen, for example as a sheet forming screen as it is required during the process of making paper. The upper fabric layer is designated by reference numeral (A), whereas the lower fabric layer is designated by reference numeral (B). The upper layer may, for example, form the paper side of a screen, and the lower layer may, for example, form the machine side of the screen.

Exactly one repeat of the fabric, i.e. the smallest repeating unit of the entire fabric is illustrated in FIGS. 1 to 7. As shown by FIGS. 1 to 7, the repeat of the fabric according to this embodiment comprises exactly sixteen longitudinal threads (=machine direction threads) (cf., for example, FIGS. 2 to 4) and exactly thirty transverse threads (=machine cross direction threads) (cf., for example, FIGS. 5 to 7). The longitudinal threads may, for example, be formed by warp threads, and the transverse threads may, for example, be formed by weft threads. Hence, the fabric shown may be produced by means of a number of sixteen shafts (corresponding to the longitudinal thread repeat of 16 threads) (cf. FIG. 8).

The sixteen longitudinal threads are distributed to the lower fabric layer and the upper fabric layer as follows. The four longitudinal threads 11, 12, 13 and 14 extend exclusively in the upper fabric layer (see, for example, FIG. 5), and will therefore hereinafter be referred to as upper longitudinal threads. The eight longitudinal threads 31, 32, 33, 34, 35, 36, 37, and 38, in contrast, extend exclusively in the lower fabric layer (see, for example, FIG. 6), and will therefore hereinafter be referred to as lower longitudinal threads.

The remaining four longitudinal threads 21, 22, 23, and 24 of the weave repeat are formed as two so-called functional pairs. The two longitudinal threads 21 and 22 arranged directly next to each other form a first functional pair, and the two longitudinal threads 23 and 24 arranged directly next to each other form a second functional pair. The four longitudinal threads 21, 22, 23 and 24 forming the two functional pairs extend each both in the lower fabric layer and in the upper fabric layer, i.e. these four longitudinal threads 21, 22, 23, and 24 change between the upper and lower fabric layers.

Figure 5:
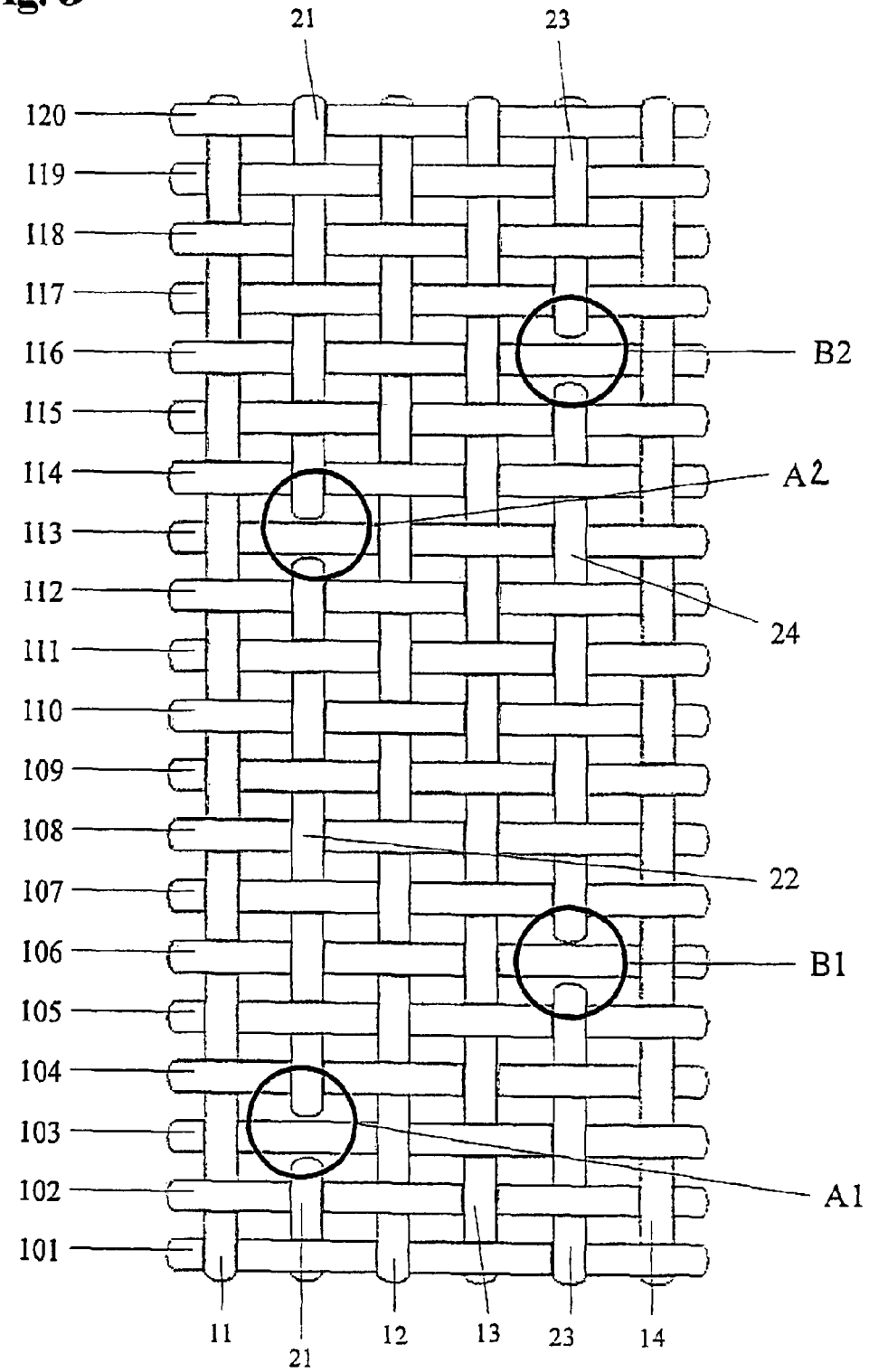
FIG. 5 shows a schematic top view of the paper side of the fabric of FIG. 1, the machine side located thereunder having been omitted.

As shown, for example, by FIG. 5, always exactly one of the two longitudinal threads of a functional pair is located on the paper side in this regard. This means that, if a first one of the two longitudinal threads of a pair is located on the paper side, the other one of the two longitudinal threads of the functional pair is located within the fabric or on the machine side. As soon as the one longitudinal thread of the pair leaves the paper side, i.e. changes into the interior of the fabric or to the machine side, the other longitudinal thread takes its place and extends on the paper side. In the exemplary embodiment shown, each longitudinal thread of a functional pair extends over a path of nine upper transverse threads on the paper side before leaving the same. Thus, the longitudinal thread 22 extends alternately above and below the nine transverse threads 104 to 112, and the longitudinal thread 21 extends alternately above and below the transverse threads 114 to 120

Figure 6:
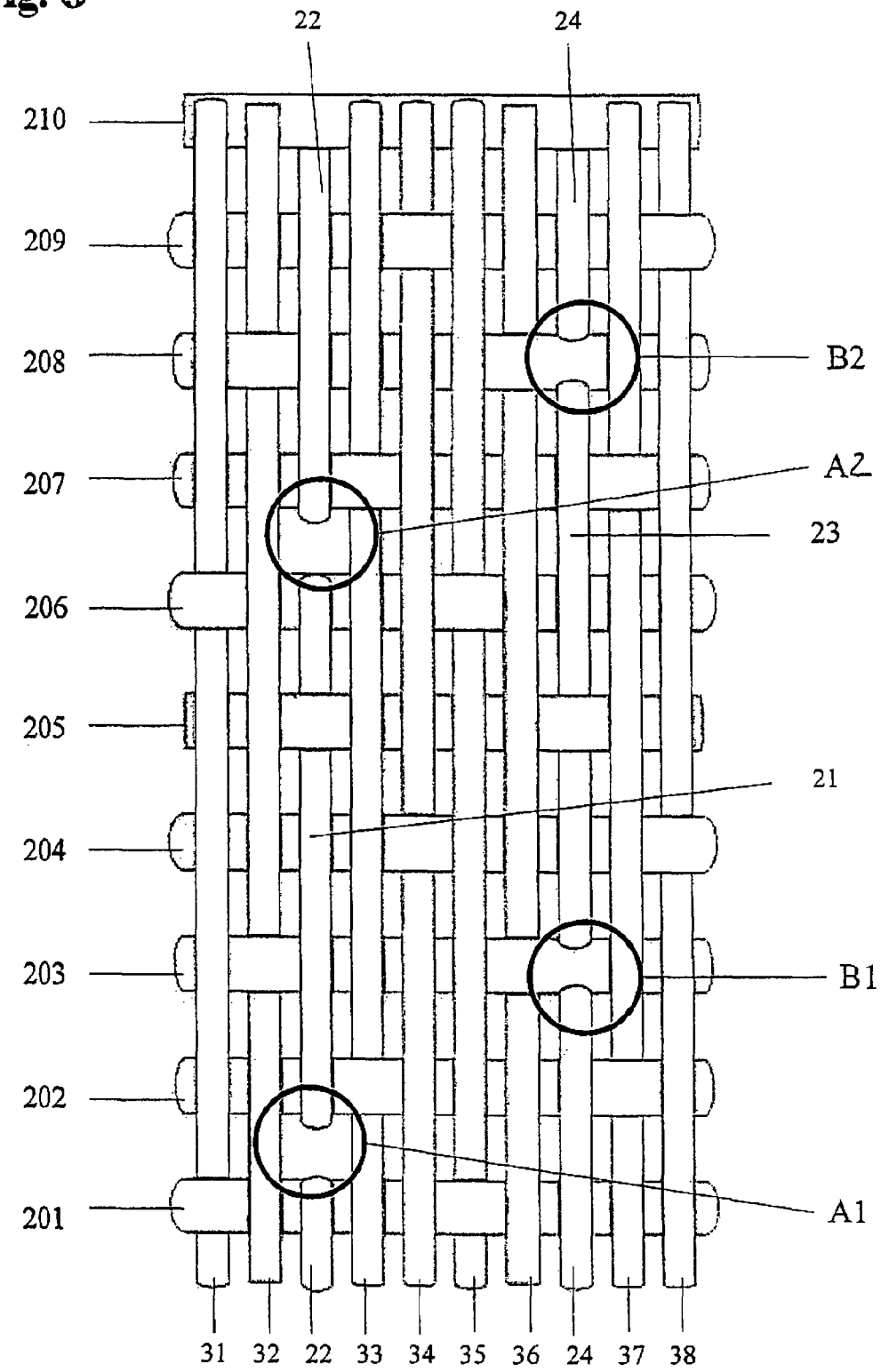
FIG. 6 shows a schematic top view of the lower fabric layer of the fabric of FIG. 1 (without the paper side located thereon)

(of the repeat shown) and 101, 102 (of the adjacent repeat). Hence, both functional pairs 21, 22 and 23, 24 form two "upper composite longitudinal threads". The upper fabric layer therefore has four upper longitudinal threads and two upper composite longitudinal threads per repeat (see FIG. 5). According to this embodiment, exactly two upper longitudinal threads 12, 13 are arranged between the two functional pairs 21, 22 and 23, 24, and between the two composite longitudinal threads, respectively. As further shown by FIG. 5, the change between the longitudinal threads of a longitudinal thread pair takes place below an upper transverse thread (and above the lower transverse threads, as shown by FIG. 6, i.e. between the lower and upper layers and in the interior of the fabric, respectively). The so-called positions of change resulting therefrom are designated by A1, A2, B1 and B2 in FIGS. 5 and 6. According to the embodiment shown, the positions of change of one functional pair are arranged to be offset by three upper transverse threads with respect to the positions of change of the other functional pair.

FIG. 5*a* shows the weave pattern of the upper fabric. In this respect, it can clearly be seen how the two longitudinal threads 21, 22 together form an upper composite longitudinal thread that inserts in the weave pattern of the paper side, i.e. the upper composite longitudinal thread 21, 22 replaces an upper longitudinal thread which would otherwise be required for forming the paper side plain weave. The same applies to the longitudinal threads 23, 24.

In addition, as shown, for example, by FIG. 6, always exactly one of the two longitudinal threads of a functional pair is located on the machine side according to this embodiment. This means that, if a first one of the two longitudinal threads of a pair is located on the machine side, the other one of the two longitudinal threads is located on the paper side. As soon as the one longitudinal thread of the pair leaves the machine side, the other longitudinal thread takes its place and extends on the machine side. In the exemplary embodiment shown, each longitudinal thread of a functional pair extends over a path of five lower transverse threads on the machine side before leaving the same. The two functional pairs 21, 22 and 23, 24 thus form simultaneously two "upper composite longitudinal threads" and two "lower composite longitudinal threads". Hence, the lower fabric layer has eight lower longitudinal threads and two lower composite longitudinal threads per repeat (see FIG. 6). According to this embodiment, exactly four lower longitudinal threads 33, 34, 35, 36 are arranged between the two functional pairs 21, 22, and 23, 24 and between the two composite longitudinal threads, respectively.

Of the thirty transverse threads, twenty transverse threads 101 to 120 are assigned to the upper fabric layer and the paper side, respectively, and ten transverse threads 201 to 210 are assigned to the lower fabric layer and the machine side, respectively. The twenty transverse threads 101 to 120 of the upper layer are smaller in diameter than the ten transverse threads 201 to 210 of the lower layer. The twenty transverse threads 101 to 120 extend exclusively in the upper fabric layer, and the ten transverse threads 201 to 210 extend exclusively in the lower fabric layer. This means that none of the transverse threads 101 to 120 changes to the machine side and none of the transverse threads 201 to 210 changes to the paper side. Hereinafter, the transverse threads 101 to 120 will therefore be referred to as upper transverse threads and the transverse threads 201 to 210 will be referred to as lower transverse threads. It should be noted that the invention is limited neither to the shown number of upper and lower transverse threads nor to the shown ratio of upper transverse threads to lower transverse threads (here: 2:1). In addition, the diameter of the upper transverse threads may, for example, be equal to or greater than the diameter of the lower transverse threads.

As shown in FIG. 5, the four upper longitudinal threads 11 to 14 and the two upper composite longitudinal threads formed by the two functional pairs 21, 22 and 23, 24 form together with the twenty upper transverse threads 101 to 120 a plain weave on the paper side and in the upper fabric layer, respectively. In this respect, the upper longitudinal thread 11 extends alternately above one and below one of the upper transverse threads 101 to 120 (succession/sequence=1*time above, 1*time below). The same applies to the upper composite longitudinal thread 21, 22, the extension of which above and below the upper transverse threads being offset with respect to the extension of the upper longitudinal thread 11 by one upper transverse thread. This means that, while the upper longitudinal thread 11 extends above the upper transverse thread 101 and below the upper transverse thread 102, the upper composite longitudinal thread 21, 22 extends below the upper transverse thread 101 and above the upper transverse thread 102. The upper longitudinal thread 12 and the upper composite longitudinal thread 23, 24 have the same extension as the upper longitudinal thread 11, and the extension of the upper longitudinal threads 13 and 14 with respect to the upper transverse threads 101 to 120 corresponds to that of the upper composite longitudinal thread 21, 22. In other words, each of the upper longitudinal threads and upper composite longitudinal threads binds every second upper transverse thread into the fabric. However, it should be noted that the invention is not limited to a paper side plain weave, even if it has proven to be absolutely suitable in this regard. At the location designated by reference numeral A1, thread 21 plunges in the interior of the fabric and changes to the lower layer. In exchange, thread 22 changes to the paper side at the position designated by reference number A1 and "replaces" thread 21 there. At the location designated by reference numeral A2, thread 22 re-plunges into the interior of the fabric and changes to the lower layer. In exchange, thread 21 changes to the paper side at the position designated by A2 and "replaces" thread 22 there.

As shown by FIG. 6, the eight lower longitudinal threads 31 to 38 and the two lower composite longitudinal threads formed by the two functional pairs 21, 22 and 23, 24 form a 5-shaft weave together with the ten lower transverse threads 201 to 210 on the machine side and in the lower fabric, respectively. The embodiment/configuration shown of the machine side is, however, only one of several possible exemplary embodiments, i.e. other machine side weaves may be provided, even if the weave shown has proven to be appropriate in this regard. Each of the lower longitudinal threads 31 to 38 and lower composite longitudinal threads 21, 22 and 23, 24 within the fabric repeat shown in FIG. 1 binds in exactly two lower transverse threads and floats over the remaining eight lower transverse threads (cf. FIG. 6*a*). The succession/sequence is as follows: "over four lower transverse threads, below a lower transverse thread". Thus, for example the lower longitudinal thread 31 weaves in the lower transverse threads 201 and 206 and floats over the lower transverse threads 202 to 205 and 207 to 210. The pitch of the 5-shaft weave shown in FIG. 6 is two or two lower transverse threads. This means that the next longitudinal thread 32 (i.e. the lower longitudinal thread adjacent to the lower longitudinal thread 31) weaves in the lower transverse threads 203 and 208, and the following lower composite longitudinal thread 21, 22 weaves in the lower transverse threads 205 and 210, etc. The 5-shaft weave formed by the lower longitudinal threads 31, 32, 33, 34 and the lower composite longitudinal thread 21, 22 is repeated by the lower longitudinal threads 35, 36, 37, 38 and the lower composite longitudinal thread 23, 24. In other words, FIG. 6 shows two longitudinal thread repeats of the machine side 5-shaft weave (as well as two transverse thread repeats, so that altogether four repeats of the machine side weave are shown).

According to the embodiment shown in FIGS. 1 to 7, both the weave of the upper fabric layer and the weave of the lower fabric layer are therefore completed by the two functional pairs 21, 22 and 23, 24. This means that the longitudinal threads 21, 22, 23, 24 (for example warp threads) are interwoven both with the upper transverse threads (for example face wefts) and the lower transverse threads (for example ground wefts), thereby completing the respective fabric or the respective weave. In other words, the two functional pairs 21, 22 and 23, 24 contribute to forming the respective weave, in the embodiment shown to the paper side plain weave and the machine side 5-shaft weave. In addition, the paper side and the machine side are interconnected by the two functional pairs 21, 22 and 23, 24.

The longitudinal threads of the two functional pairs 21, 22 and 23, 24 serve as fabric-internal threads in the lower fabric and in the upper fabric and act as binder threads at the same time. Thus, according to this embodiment, the threads of the functional pairs are used both in the lower fabric and on the machine side, respectively, and in the upper fabric and on the paper side, respectively, as an essential part of the corresponding fabric. Their weaving in the respective fabric serves not only for binding the lower fabric to the upper fabric but also for forming functional binding points within the corresponding fabric.

The above-described completion of the paper side and machine side weaves by the two functional pairs is especially obvious from a combination of FIGS. 5 and 6. In this respect, thread 22 in FIG. 5 weaves in the upper transverse threads 104, 106, 108, 110 and 112, and completes the paper side plain weave in this respect, while thread 21 in FIG. 6 weaves in the lower transverse thread 205 and thereby completes the machine side 5-shaft weave (without this weaving, the transverse thread 205 would fall down from the fabric, as it is woven in by none of the lower longitudinal threads). If thread 22 changes downwards, in order to weave in the lower transverse thread 210 in FIG. 6, whereby the machine side weave is completed, thread 21 changes upwards, in order to weave in the upper transverse threads 114, 116, 118 and 120, thereby completing the paper side plain weave. Consequently, both longitudinal threads 21 and 22 alternately complete the paper side weave (according to this embodiment a plain weave) and the machine side weave (according to this embodiment a 5-shaft weave).

Figure 7:
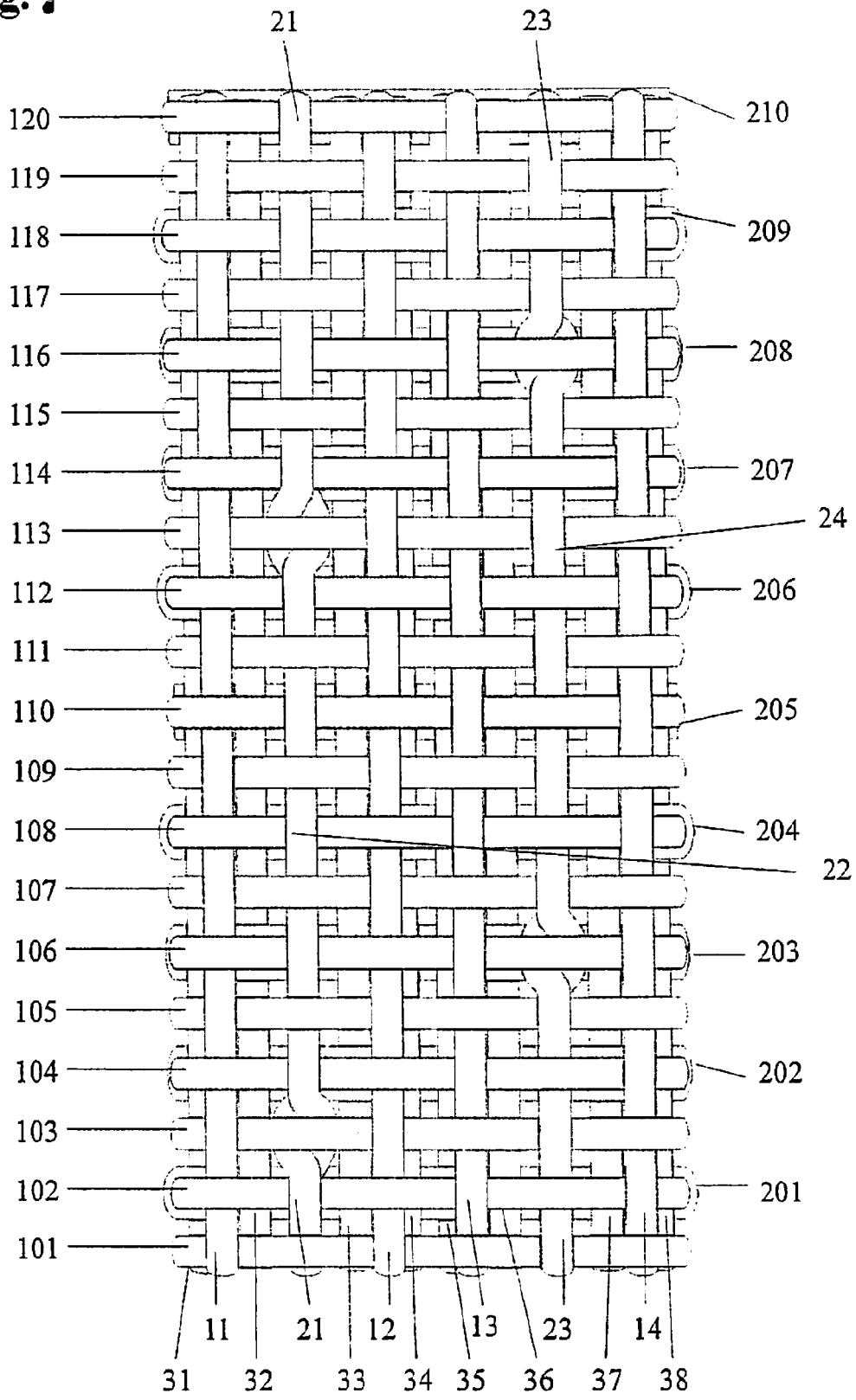
FIG. 7 shows a schematic top view of the entire fabric of FIG. 1, i.e. a top view of both the paper side (upper fabric) and the machine side (lower fabric) located thereunder, including the changing locations of the functional pairs.

FIG. 7 shows the two layers which are shown in FIG. 5 and FIG. 6 in a separate manner as an "assembled" drawing. Both layers are shown in a top view. The upper layer represents the paper side of a sheet forming screen.

As shown in FIG. 7, an upper longitudinal thread lies basically always between two lower longitudinal threads as seen in a top view of the fabric. In this regard, the upper longitudinal thread 11 is located in a top view substantially between the two lower longitudinal threads 31, 32, the upper longitudinal thread 12 is located mainly between the lower longitudinal threads 33, 34, the upper longitudinal thread 13 is located substantially between the lower longitudinal threads 35, 36, and the upper longitudinal thread 14 is located substantially between the lower longitudinal threads 37, 38. This results in a ratio of upper to lower longitudinal threads of 4:8 or 1:2. If the four longitudinal threads 21, 22, 23, 24 of the functional pairs are distributed evenly to the lower fabric layer and the upper fabric layer (as they contribute to forming the fabric in both layers and form two composite longitudinal threads in each layer), a longitudinal thread ratio of 6:10 or 3:5 is obtained (cf. FIG. 2).

As also shown by FIG. 7, the formation of so-called transverse meshes (the extension of which in a machine direction/longitudinal direction is less than in the transverse direction) on the paper side is favored by the comparatively small number of upper longitudinal threads and upper composite longitudinal threads (resulting from the longitudinal thread ratio of 6:10 and 3:5, respectively). Such transverse meshes enable an advantageous support of the fibers contained in the fiber suspension. The comparatively large number of lower longitudinal threads and lower composite longitudinal threads can balance the reduction in strength on the paper side and the increase in screen expansion in the machine direction going along with the formation of the transverse meshes.

As also shown in FIG. 7, an upper transverse thread is arranged above every lower transverse thread in a top view. In addition, an upper transverse thread is always arranged between two lower transverse threads. This results is a ratio of upper to lower transverse threads of 20:10 or 2:1. As already explained above, this ratio may be varied, though. However, an increased number of upper transverse threads favors the formation of the transverse meshes.

According to the embodiment shown in FIGS. 1 to 7, the diameter of the upper longitudinal threads 11 to 14 is equal to the diameter of the threads 21 to 24 of the functional pairs. Thereby, on the one hand, a uniform paper side can be obtained. Uniformity of the paper side is slightly affected by the four change positions A1, A2, B1 and B2 of the two functional pairs only. The paper side weave is almost not "interfered with" at all by the ratio shown of four upper longitudinal threads to two functional pairs and two upper composite longitudinal threads, respectively, and especially not by the distribution shown of upper longitudinal threads and functional pairs (two upper longitudinal threads between the functional pairs), compared to the paper side weaves of the state of the art where only upper composite longitudinal threads or upper longitudinal threads and upper composite longitudinal threads are provided alternately. On the other hand, the upper longitudinal threads 11 to 14 and the threads 21 to 24 of the functional pairs can be applied to the same warp beam without any difficulties (warp beam X2 in FIG. 8).

The diameter of the lower longitudinal threads 31 to 38 may, for example, be equal to the diameter of the upper longitudinal threads 11 to 14 and the threads 21 to 24 of the functional pairs according to the embodiment shown in FIGS. 1 to 7, whereby a uniform machine side is obtained which is interrupted only by the four change positions A1, A2, B1 and B2.

For clarification and in a very simplified manner, FIG. 2 shows once again the functional distribution of the longitudinal threads to the paper side (A) and the machine side (B). This may, in the first instance, give the impression that the described fabric can be made by eight shafts and with a longitudinal thread repeat of 3:5, respectively. As shown by FIG. 5, the extension of the upper longitudinal thread 11 is not similar to that of the upper longitudinal thread 13, though.

Figure 1:
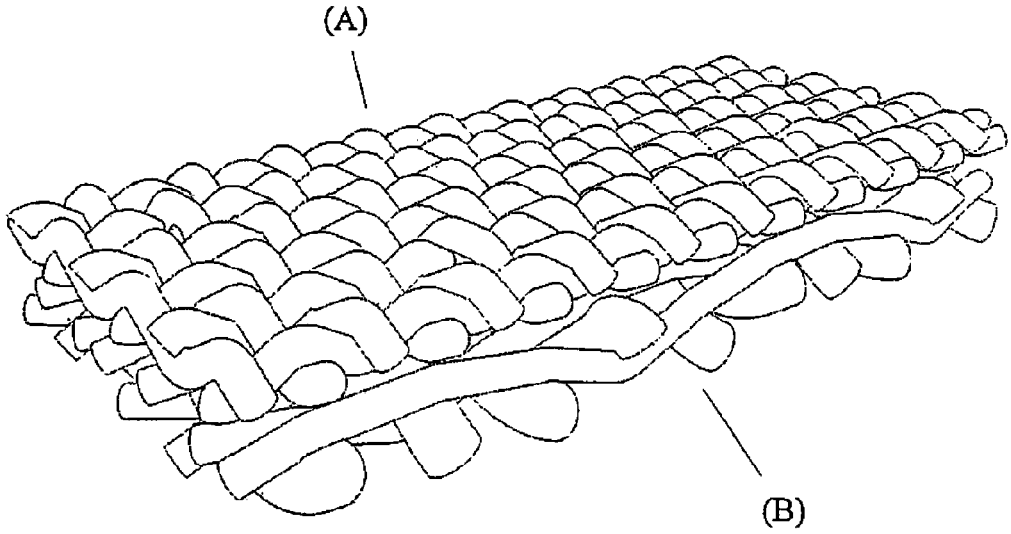
FIG. 1 shows a perspective view of a schematically illustrated complete repeat of a fabric according to the present invention, the upper fabric layer being designated by (A) and the lower fabric layer being designated by (B)
Figure 2:
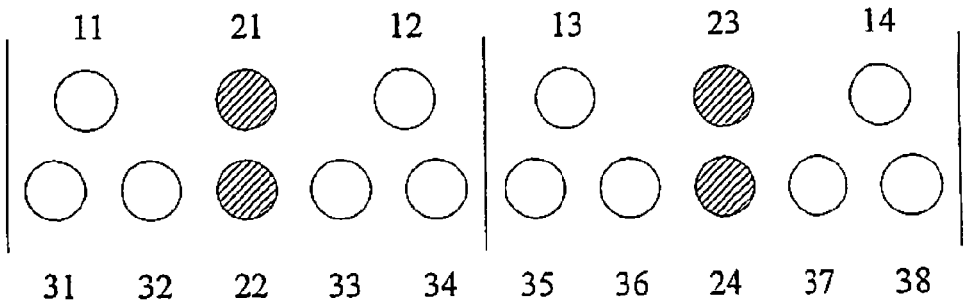
FIG. 2 shows a simplified illustration of the distribution of the sixteen longitudinal threads to the two fabric layers, the transverse threads having been omitted.
Figure 3:
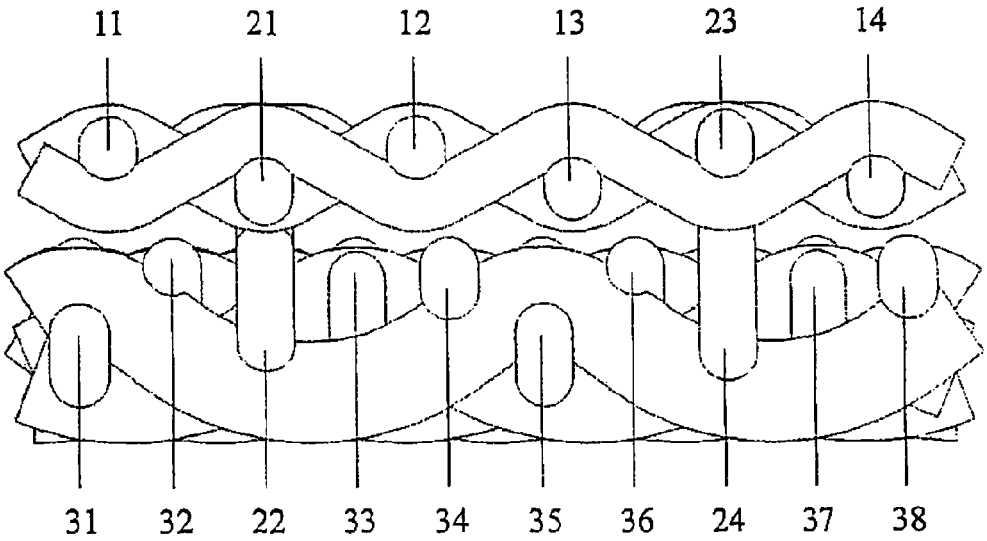
FIG. 3 shows a front view of the fabric of FIG. 1 (the cross-sectional surface of the longitudinal threads and the transverse thread extension can be seen)
Figure 4:
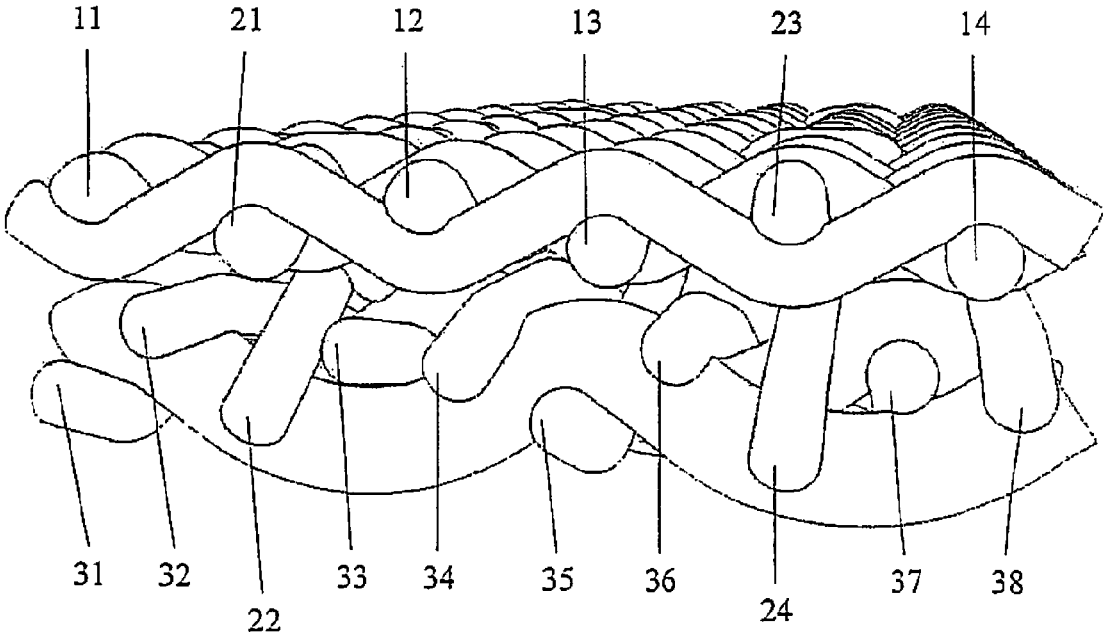
FIG. 4 shows a perspective view of the fabric of FIG. 1, in which the ratio of the longitudinal threads (and the warp threads, respectively) of 6 to 10 and the fundamental extension of the paper side and the machine side transverse threads of the weave of FIG. 1 can be seen.

FIGS. 1, 3 and 4 show three-dimensional views of the described fabric and the sheet forming screen, respectively.

Figure 8:
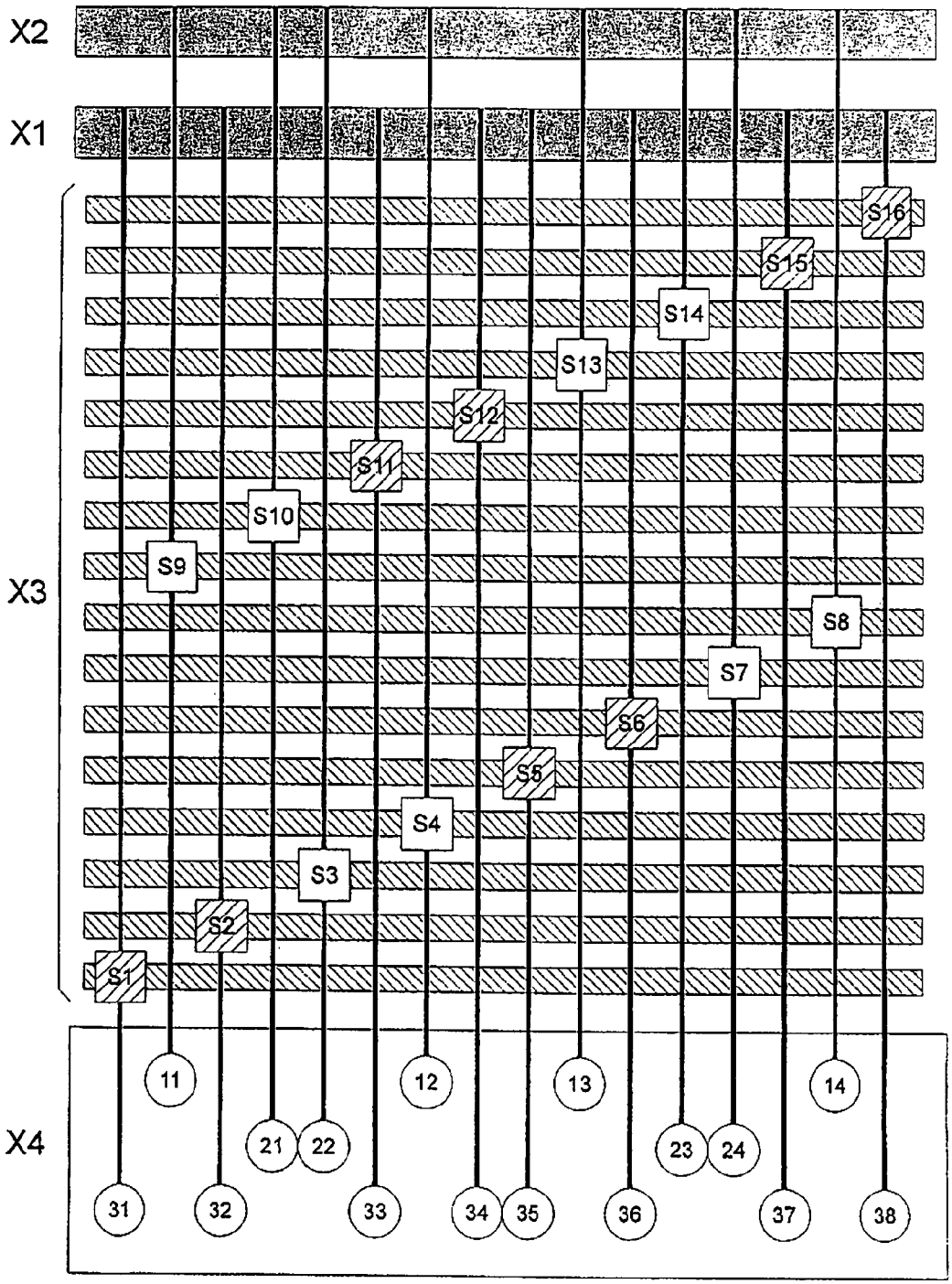
FIG. 8 shows a schematic top view relating to the sequencing of the sixteen warp threads of a repeat in the sixteen shafts of a weaving machine for realizing the fabric of FIGS. 1 to 7.

FIG. 8 shows a schematic view a weaving machine for producing the fabric according to FIGS. 1 to 7. Two warp beams X1 and X2 are shown. The first warp beam X1 carries the lower longitudinal threads, and the second warp beam X2 carries the upper longitudinal threads and the longitudinal threads of the functional pairs. Of course, FIG. 8 shows only a small portion of the two warp beams (in accordance with a longitudinal thread repeat), i.e., as seen in the longitudinal direction of the warp beam X1, thread 38 is followed by another thread 31, then by another thread 32, etc. Thread 31 of the warp beam X1 is hooked into the shaft S1 or is led through the same. The other thread 31 mentioned above and not shown is also hooked into the shaft S1 (just like all other threads 31 of the fabric). If shaft S1 is lifted, all threads 31 are lifted together with shaft S1, so that a weft thread can be led-through below all threads 31. In a similar way, all upper longitudinal threads 32 are hooked into the second shaft S2, all upper longitudinal threads 33 are hooked into the eleventh shaft S11, etc. For producing the fabric shown in FIGS. 1 to 7 (which is schematically shown in FIG. 8 and designated by reference numeral X4), which has a longitudinal thread repeat of sixteen longitudinal threads, a shaft package X3 is therefore required, if the longitudinal threads are made of warp threads, which consists of sixteen shafts S1, S2, S3, . . . , S16.

This means that the 16 longitudinal threads are separated into two units of 8 threads each, an individual warp beam X1 and X2, respectively, being assigned to each unit, and the threads being disposed in the shafts X3 of the weaving loom individually according to their function. This results in a logical allocation of the warp threads in accordance with their function which has been described above.

A plurality of different fabrics can be produced by means of the described assembly of a 16-shaft shaft package X3 in connection with two warp beams X1 and X2, especially fabrics where the connection of upper fabric and lower fabric is obtained by functional longitudinal thread pairs. Examples of such fabrics are the screen and fabric, respectively, as described, for example, in DE 100 30 650 C1 and in WO 2007/087852. Consequently, a number of fabrics/screens can be produced by means of one and the same weaving machine without having to reconstruct the weaving machine in the meantime.

Figure 9:
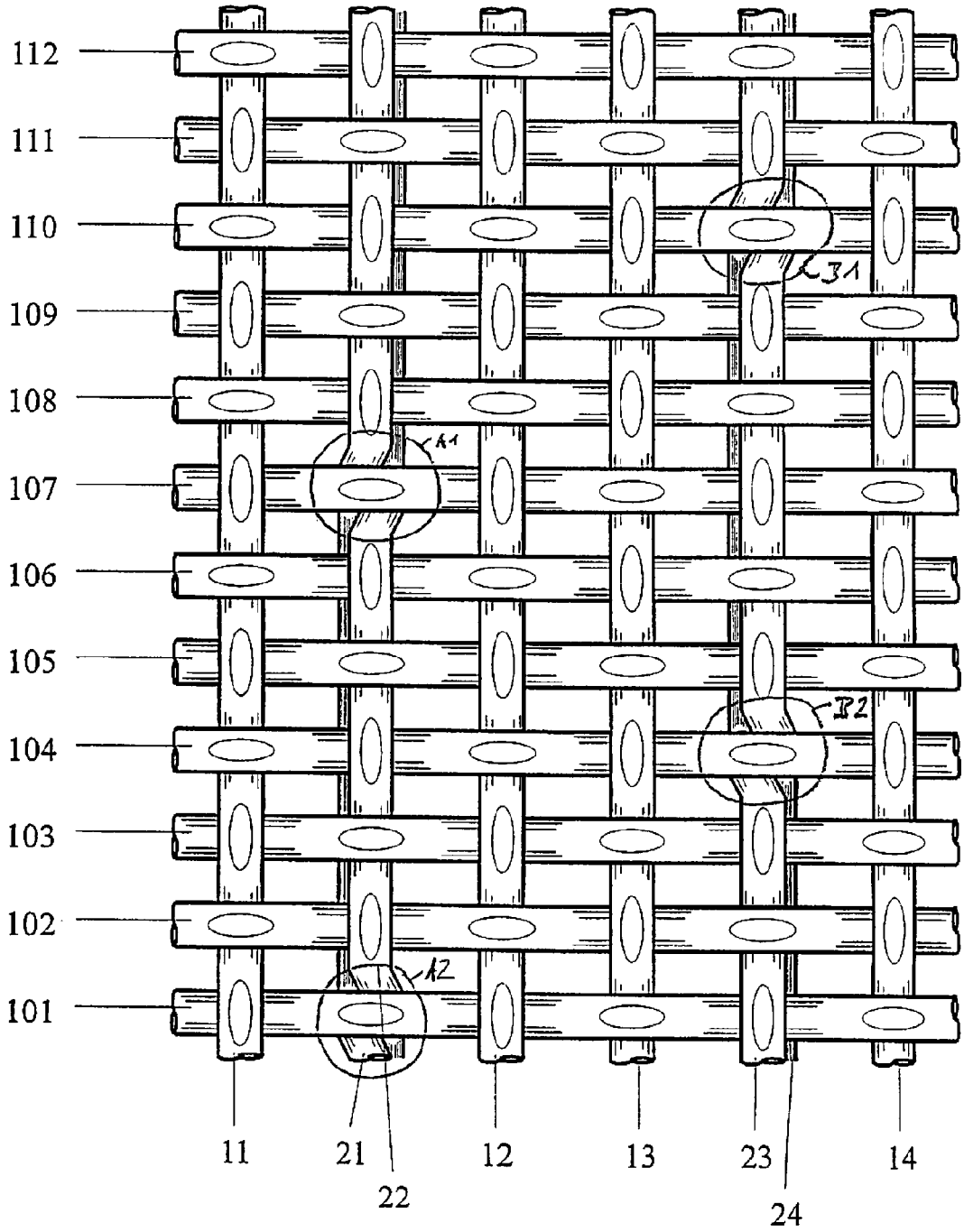
FIG. 9 shows a schematic top view of the upper fabric layer of a multi-layer fabric according to a second embodiment of the invention, the lower fabric layer having been omitted.
Figure 10:
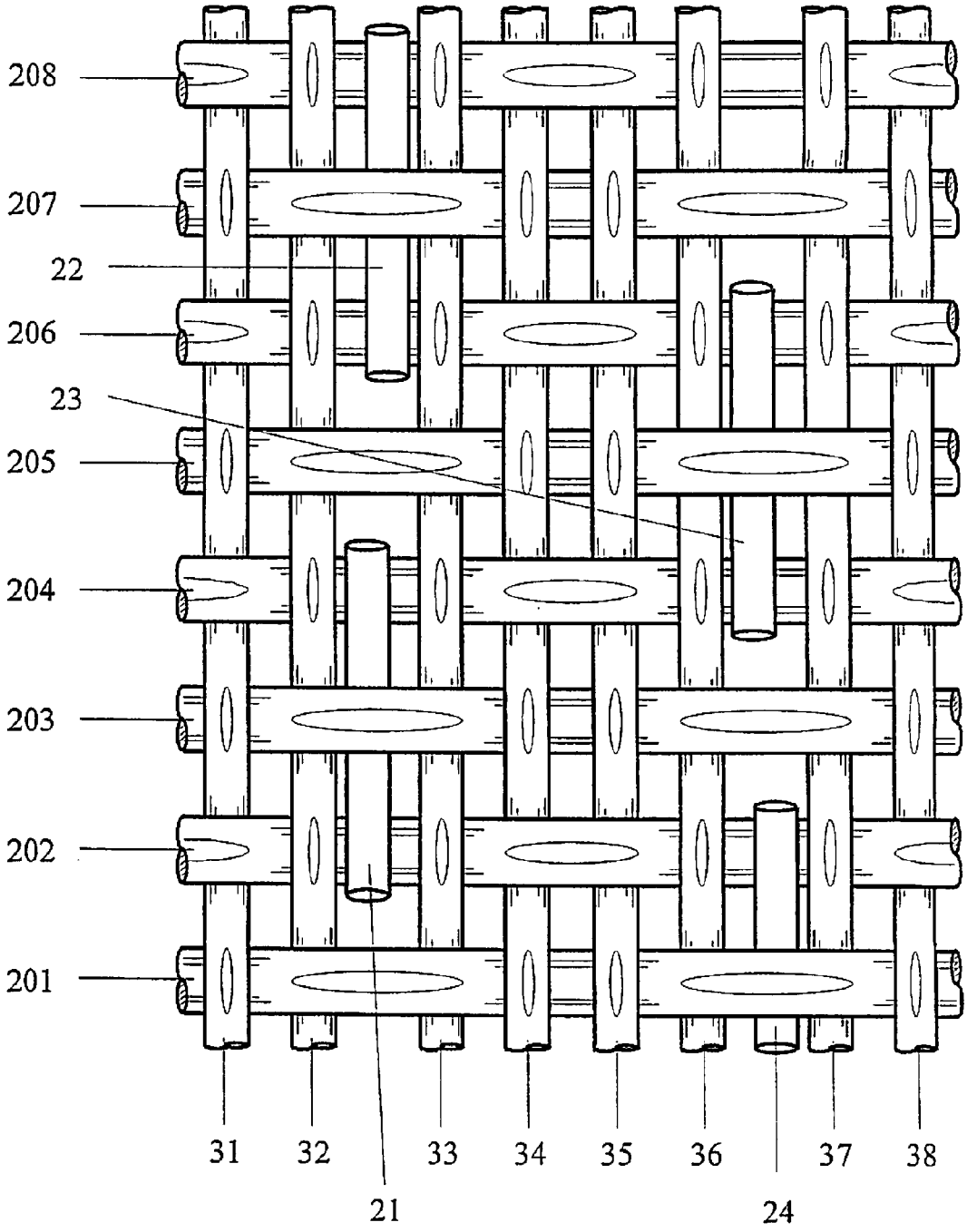
FIG. 10 shows a schematic top view of the lower fabric layer of the multi-layer fabric according to the second embodiment of the invention.
Figures 10A, 11:
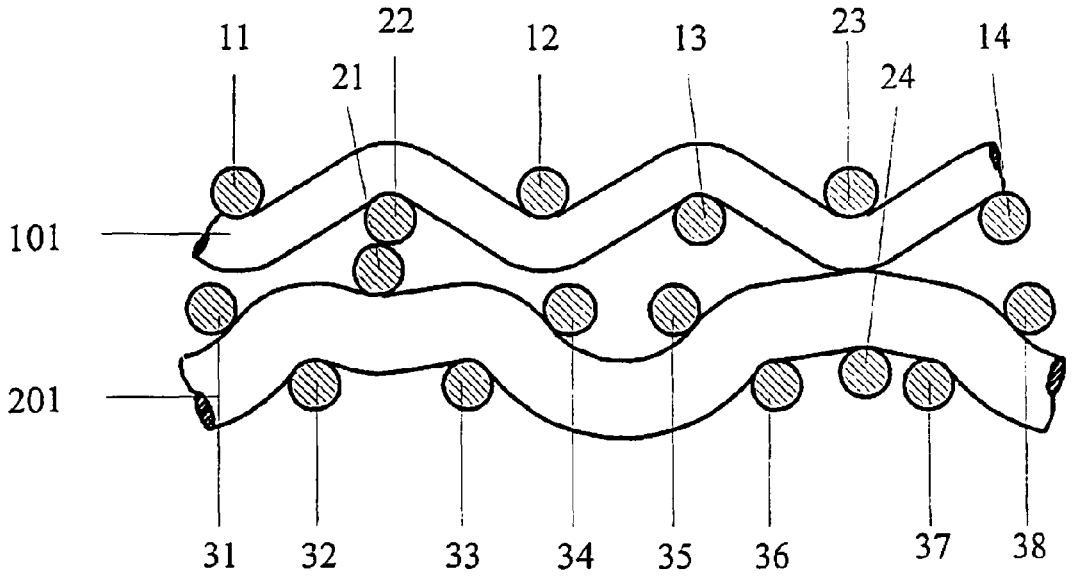
FIG. 10*a* shows the weave pattern of the lower fabric, the binding locations where a lower transverse thread is bound in by a lower longitudinal thread being marked with an "x", and the binding locations where the lower fabric is bound to the upper fabric by means of a longitudinal thread of a functional longitudinal thread pair being marked with a "–"
FIG. 11 shows a schematic front view of the fabric according to the second embodiment of the invention.

FIGS. 9 to 11 show a multi-layer fabric according to a second embodiment of the invention, which can, for example, be used as a screen, for example as a sheet forming screen as it is required during the process of making paper. In this respect, FIG. 9 shows a top view of the upper fabric layer (i.e. the paper side of the screen), whereas FIG. 10 shows a top view of the lower fabric layer. FIG. 11 shows a front view of the multi-layer fabric.

FIGS. 9 and 10 show exactly one repeat of the fabric. As shown by FIGS. 9 and 10, the repeat of the fabric according to this embodiment consists of exactly sixteen longitudinal threads (=machine direction threads) and exactly twenty transverse threads (=machine cross direction threads). The longitudinal threads may, for example, be formed by warp threads, and the transverse threads may, for example, be formed by weft threads. The fabric according to the second embodiment can therefore be produced just like the fabric according to the first embodiment by means of a number of sixteen shafts, i.e., for example by means of the assembly shown in FIG. 8.

The sixteen longitudinal threads are distributed to the lower fabric layer and the upper fabric layer as follows. The four longitudinal threads 11, 12, 13 and 14 are formed as upper longitudinal threads and extend exclusively in the upper fabric layer (see FIG. 9), whereas the eight longitudinal threads 31, 32, 33, 34, 35, 36, 37 and 38 are formed as lower longitudinal threads which extend exclusively in the lower fabric layer (see FIG. 10). Two functional pairs are formed from the remaining four longitudinal threads 21, 22, 23 and 24 of the fabric repeat, the two longitudinal threads 21 and 22 arranged directly next to each other forming a first functional pair and the longitudinal threads 23 and 24 located directly next to each other forming a second functional pair in this regard. Each of the four longitudinal threads 21, 22, 23 and 24 extends both in the lower fabric layer and in the upper fabric layer, i.e. each of these four longitudinal threads 21, 22, 23 and 24 changes between upper and lower fabric layers within a repeat.

As shown in FIGS. 9 and 9*a*, exactly one of the two longitudinal threads of a functional pair is always on the paper side and in the upper fabric layer, respectively. This means that, if one of the two longitudinal threads of a pair is located on the paper side and in the upper fabric layer, respectively, the other one of the two longitudinal threads of the functional pair is located within the fabric (i.e. between the upper and lower layers) or in the lower fabric layer. As soon as the one longitudinal thread of the functional pair leaves the paper side, the other longitudinal thread takes its place and extends on the paper side. In the exemplary embodiment shown, each longitudinal thread of a functional pair extends over a path of five upper transverse threads on the paper side and weaves in three transverse threads at the same time. Hence, both functional pairs 21, 22 and 23, 24 form two "upper composite longitudinal threads", so that the upper fabric layer has four upper longitudinal threads and two upper composite longitudinal threads per longitudinal thread repeat of the fabric. According to this embodiment, exactly two upper longitudinal threads 12, 13 are arranged between the two functional pairs 21, 22 and 23, 24 and between the two composite longitudinal threads, respectively. The longitudinal thread change of the first longitudinal thread pair 21, 22 takes place underneath the upper transverse threads 101 and 107, that of the second longitudinal thread pair 23, 24 underneath the upper transverse threads 104 and 110. The resulting change positions are designated by reference numerals A1, A2, B1 and B2 in FIG. 9. The change positions of the one functional pair are arranged to be offset by three upper transverse threads with respect to the change positions of the other functional pair.

As illustrated by FIGS. 10 and 10*a*, the longitudinal thread portion of a functional longitudinal thread pair which is currently not located in the upper fabric layer binds the lower fabric layer to the upper fabric layer by extending under at least one (in the example shown exactly one) lower transverse thread and thereby weaving in the same (in a top view of the lower fabric layer). In this respect, the longitudinal thread of the functional thread pair binding the lower fabric acts as a separate, "fabric-external" binder thread with respect to the lower fabric, i.e. the thread binding the lower fabric does not contribute to the formation of the machine side weave and to the formation of the lower fabric, respectively. This means that, according to this embodiment, the two functional pairs 21, 22 and 23, 24 do not form any "lower composite longitudinal threads". This is shown in FIGS. 10 and 10*a* for example by the fact that the lower longitudinal threads extend alternately above and below the transverse threads of the lower fabric, thereby weaving in four transverse threads, whereas the two longitudinal threads of a functional pair—if considered as lower composite thread—only weave in two lower transverse threads together and have an extension of "below one transverse thread, above three transverse threads". In addition, according to the machine side 5-shaft weave, each transverse thread is woven in exactly twice per machine side repeat (FIG. 10 shows four repeats of the machine side weave, see below), the lower transverse threads 203, 207 bound by the functional pair 21, 22 already being woven in twice by the lower longitudinal threads 32, 33. Hence, the lower fabric layer has exactly eight lower longitudinal threads per longitudinal thread repeat. According to this embodiment, exactly four lower longitudinal threads 33, 34, 35, 36 are arranged between the two functional pairs 21, 22 and 23, 24.

Twelve transverse threads 101 to 112 of the twenty transverse threads are assigned to the upper fabric layer, and eight transverse threads 201 to 208 of the twenty transverse threads are assigned to the lower fabric layer. The twelve transverse threads 101 to 112 of the upper layer are smaller in diameter than the eight transverse threads 201 to 208 of the lower layer. The twelve transverse threads 101 to 112 are formed as upper transverse threads and extend exclusively in the upper fabric layer, and the eight transverse threads 201 to 208 are formed as lower transverse threads which extend exclusively in the lower fabric layer. This means that none of the transverse threads 101 to 112 changes to the machine side and in the lower fabric layer, respectively, and none of the transverse threads 201 to 208 changes to the paper side and into the upper fabric layer, respectively. However, it should be noted that the invention is limited neither to the shown number of upper and lower transverse threads nor to the shown ratio of upper transverse threads to lower transverse threads (here: 12:8 or 3:2). In addition, the diameter of the upper transverse threads may, for example, be equal to or greater than the diameter of the lower transverse threads.

As shown in FIG. 9, the four upper longitudinal threads 11 to 14 and the two upper composite longitudinal threads formed by the two functional pairs 21, 22 and 23, 24 form a paper side plain weave together with the twelve upper transverse threads 101 to 112. In this respect, the upper longitudinal thread 11 extends alternately above and below an upper transverse thread 101 to 112 (succession/sequence=once above, once below). The extension of the upper composite longitudinal thread 21, 22 is offset with respect to the extension of the upper longitudinal thread 11 by exactly one upper transverse thread. The upper longitudinal thread 12 and the upper composite longitudinal thread 23, 24 have the same extension as the upper longitudinal thread 11, and the extension of the upper longitudinal threads 13 and 14 corresponds to the extension of the upper composite longitudinal thread 21, 22. Hence, each of the upper longitudinal thread and the upper composite longitudinal thread weaves every second upper transverse thread into the fabric. Even if this weave has proven to be appropriate for the upper fabric and the paper side, respectively, the invention is not limited to a paper side plain weave.

As shown by FIG. 10, the eight lower longitudinal threads 31 to 38 form a machine side 4-shaft weave together with the eight lower transverse threads 201 to 208. The embodiment/configuration shown of the lower fabric is, however, only one of several possible exemplary embodiments, i.e. other machine side weaves may be provided as well, even if the weave shown has proven to be appropriate in this regard. Each of the eight lower longitudinal threads 31 to 38 extends alternately above and below a lower transverse thread and thereby weaves in exactly four lower transverse threads. In this respect, for example, the lower longitudinal thread 31 weaves in the lower transverse threads 202, 204, 206 and 208, and the lower longitudinal thread 32 weaves in the lower transverse threads 201, 203, 205 and 207, i.e. the extension of the longitudinal thread 32 arranged adjacent to the longitudinal thread 31 is offset by one transverse thread. The extension of the longitudinal thread 33 arranged adjacent to the longitudinal thread 32 corresponds to the extension of the longitudinal thread 32, and the extension of the longitudinal thread 34 arranged adjacent to the longitudinal thread 33 corresponds to the extension of the longitudinal thread 31. The 4-shaft weave formed by the lower longitudinal threads 31, 32, 33 and 34 is repeated by the lower longitudinal threads 35, 36, 37, and 38. In addition, the machine side 4-shaft weave is repeated after four lower transverse threads. In other words, four repeats of the machine side 4-shaft weave are shown in FIGS. 10 and 10*a*. Every lower transverse thread is woven in twice per machine side weave repeat.

According to the embodiment shown in FIGS. 9 to 11, only the weave of the upper fabric layer is thus completed by the longitudinal threads of the two functional pairs 21, 22 and 23, 24. The weave of the lower fabric layer is formed by the eight lower longitudinal threads (together with the transverse threads extending in the lower fabric) only. The longitudinal threads of the two functional pairs 21, 22 and 23, 24 are used as separate binder threads in the lower fabric, which bind an already completely formed fabric to the upper fabric.

If the upper fabric layer shown in FIG. 9 is laid onto the lower fabric layer shown in FIG. 10 (corresponding to FIG. 7 of the first embodiment), the top view of the fabric always shows an upper longitudinal thread between two lower longitudinal threads. In this respect, the upper longitudinal thread 11 lies, in a top view, substantially between the two lower longitudinal threads 31, 32 (cf. FIG. 11), the upper longitudinal thread 21 lies substantially between the lower longitudinal threads 33, 34, the upper longitudinal thread 13 lies substantially between the lower longitudinal threads 35, 36, and the upper longitudinal thread 14 lies substantially between the lower longitudinal threads 37, 38. This results in a ratio of upper to lower longitudinal threads of 4:8 or 1:2. If, in addition, the two upper composite longitudinal threads formed by the four longitudinal threads 21, 22, 23, 24 are assigned to the upper fabric layer, a longitudinal thread ratio of 6:8 or 3:4 is obtained (if none of the four longitudinal threads 21, 22, 23, 24 which have no fabric function in the lower fabric layer according to this embodiment but only act as separate fabric threads is assigned to the lower fabric layer). If the four longitudinal threads 21, 22, 23, 24 are distributed evenly to the upper fabric and the lower fabric, a ratio of 6:10 or 3:5 is obtained, just like in the first embodiment. The described longitudinal thread ratio of 6:8 (and 6:10, respectively) and the reduced longitudinal thread number on the paper side going along therewith favors the formation of transverse meshes (see FIG. 9) which allow an advantageous fiber support. The comparatively large number of lower longitudinal threads balances the reduction in strength and the increase in screen expansion in the machine direction going along with the formation of the transverse meshes.

Just like in the fabric according to the first embodiment, the diameter of the upper longitudinal threads 11 to 14 in the fabric according to the second embodiment can be equal to the diameter of the threads 21 to 24 of the functional pairs. Thereby, a uniform paper side can be obtained which is only slightly interfered with by the four change locations A1, A2, B1 and B2. In addition, the upper longitudinal threads 11 to 14 and the threads 21 to 24 of the functional pairs can be arranged without any difficulties on a common warp beam (for example warp beam X2 in FIG. 8).

The diameter of the lower longitudinal threads 31 to 38 can for example, just like in the fabric according to the first embodiment, be equal to the diameter of the upper longitudinal threads 11 to 14 and the threads 21 to 24 of the functional pairs. It is, however, also possible to use threads with a greater diameter for the lower longitudinal threads, as the lower longitudinal threads can be applied to a separate warp beam (for example warp beam X1 in FIG. 8), and the machine side weave is formed exclusively by the lower longitudinal threads. If the lower longitudinal threads are greater in diameter than the longitudinal threads of the functional pairs, the lower longitudinal threads protrude from the machine side further than the longitudinal threads of the functional pairs extending in sections in the lower fabric, so that the longitudinal threads of the functional pairs acting as separate binder threads are protected by the lower longitudinal threads against abrasion and wear.

The fabric according to the second embodiment can be produced by means of the weaving machine and warp thread assembly shown in FIG. 8, just like the fabric according to the first embodiment.

What is claimed is:

1. Sheet forming screen, formed as a multi-layer fabric having an upper fabric layer (A) comprising a first weave, and a lower fabric layer (B) comprising a second weave, wherein the multi-layer fabric has a longitudinal thread repeat of sixteen longitudinal threads, four longitudinal threads (11, 12, 13, 14) of which are formed as upper longitudinal threads extending exclusively in the upper fabric layer and being interwoven with transverse threads (101 to 120, 101 to 112) extending in the upper fabric layer, thereby partially forming the first weave, eight longitudinal threads (31, 32, 33, 34, 35, 36, 37, 38) of which are formed as lower longitudinal threads extending exclusively in the lower fabric layer and there being interwoven with transverse threads (201 to 210, 201 to 208) extending in the lower fabric layer, and the remaining four longitudinal threads (21, 22, 23, 24) of which form two functional longitudinal thread pairs (21, 22; 23, 24) of two longitudinal threads each arranged next to each other, the two longitudinal threads of the respective longitudinal thread pair alternately completing the first weave, and one or more or all of the four longitudinal threads forming the two functional longitudinal thread pairs extending both in the upper fabric layer and in the lower fabric layer and thereby binding the lower fabric layer to the upper fabric layer.

2. Sheet forming screen according to claim 1, wherein the eight lower longitudinal threads (31, 32, 33, 34, 35, 36, 37, 38) are interwoven with the transverse threads (201 to 210) extending in the lower fabric layer, thereby partially forming the second weave, and wherein the two longitudinal threads of the respective longitudinal thread pair (21, 22; 23, 24) alternately complete both the first weave and the second weave.

3. Sheet forming screen according to claim 1, wherein the eight lower longitudinal threads (31, 32, 33, 34, 35, 36, 37, 38) are interwoven with the transverse threads (201 to 208) extending in the lower fabric layer, thereby completely forming the second weave, and wherein the at least one longitudinal thread extending both in the upper fabric layer and in the lower fabric layer binds the lower fabric layer completely formed by the lower longitudinal threads to the upper fabric layer.

4. Sheet forming screen according to claim 3, wherein all of the four longitudinal threads forming the two functional longitudinal thread pairs extend both in the upper fabric layer and in the lower fabric layer, and wherein the two longitudinal threads of the respective functional pair alternately bind the lower fabric layer completely formed by the lower longitudinal threads to the upper fabric layer.

5. Sheet forming screen according to claim 1, wherein always exactly two upper longitudinal threads (12, 13) and/or exactly four lower longitudinal threads (33, 34, 35, 36) are arranged in the fabric between two functional longitudinal thread pairs (21, 22; 23, 24).

6. Sheet forming screen according to claim 1, wherein the upper longitudinal threads (11 to 14), the lower longitudinal threads (31 to 38) and the longitudinal threads (21 to 24) of the functional pairs have the same diameter.

7. Sheet forming screen according to claim 3, wherein the upper longitudinal threads (11 to 14) and the longitudinal threads (21 to 24) of the functional pairs have the same diameter, and wherein the diameter of the lower longitudinal threads (31 to 38) is greater than the diameter of the upper longitudinal threads (11 to 14) and the longitudinal threads (21 to 24) of the functional pairs.

8. Sheet forming screen according to claim 1, wherein all transverse threads extending in the upper fabric layer are formed as upper transverse threads (101 to 120, 101 to 112) extending exclusively in the upper fabric layer, and/or wherein all transverse threads extending in the lower fabric layer are formed as lower transverse threads (201 to 210, 201 to 208) extending exclusively in the lower fabric layer.

9. Sheet forming screen according to claim 1, wherein the ratio of transverse threads extending in the upper fabric layer to transverse threads extending in the lower fabric layer is greater than 1, for example at least or exactly 2:1 or for example at least or exactly 3:2.

10. Sheet forming screen according to claim 1, wherein the first weave is a plain weave, and/or wherein the second weave is a 5-shaft weave or a 4-shaft weave.

* * * * *